US005584760A

United States Patent [19]

Green

[11] Patent Number: 5,584,760

[45] Date of Patent: Dec. 17, 1996

[54] VENTED STORM DOOR

[76] Inventor: John I. Green, Rte. #1, Box 135, Stillwater, Okla. 74074

[21] Appl. No.: 384,885

[22] Filed: Feb. 7, 1995

[51] Int. Cl.[6] ..... E06B 7/082

[52] U.S. Cl. ..... 454/195; 454/213

[58] Field of Search ..... 454/195, 196, 454/211, 213, 222

[56] References Cited

U.S. PATENT DOCUMENTS

| | | | |
|---|---|---|---|
| 1,771,569 | 10/1929 | Benoit | 454/195 |
| 1,885,230 | 11/1932 | Chaffee | 454/211 |
| 2,050,362 | 8/1936 | Mims . | |
| 3,094,058 | 6/1963 | O'Brien, Jr. et al. | 454/195 |
| 4,957,038 | 9/1990 | Hamilton . | |

FOREIGN PATENT DOCUMENTS

| | | | |
|---|---|---|---|
| 2251491 | 5/1974 | Germany | 454/196 |
| 1210222 | 10/1970 | United Kingdom | 454/213 |

*Primary Examiner*—Harold Joyce
*Attorney, Agent, or Firm*—Robert K. Rhea

[57] ABSTRACT

In a single glass pane type storm door frame formed by stiles and end rails the glass is supported in the frame by a ventilating assembly interposed between the pane and storm door frame. The ventilating assembly includes an H-shaped member, in cross section, having a first pair of legs adjacent and secured to the door frame inner priphery and provided with transversely aligned apertures, opened and closed by a ventilation control member slidably disposed adjacent one leg of said first pair of legs and moved by a control knob projecting laterally of the door frame for opening and closing the ventilating openings.

4 Claims, 2 Drawing Sheets

VENTED STORM DOOR

BACKGROUND OF THE INVENTION

1. Field of the Invention

This invention relates to storm doors of the full length single glass pane frame I-type and more particularly to an air vent for such a storm door.

One presently popular type of storm door comprises a single full door length glass pane which is framed by stiles and top and bottom rails. One of the stiles being provided with hinges and the opposite stile being provided with a door latch and lock.

This type of storm door performs its purpose in a satisfactory manner. However, in many areas during summertime and hot weather it is frequently desirable to allow ventilation to pass through the storm door closed opening. Propping the door open or partially open is unsatisfactory on account of flying and crawling insects and unwanted visitors.

This invention overcomes this problem by interposing a double wall extrusion between the glass pane and the inner perimeter of a storm door frame. The walls of the extrusion is provided with mating and mismating apertures through which air may flow or be interrupted.

2. Description of the Prior Art

The most pertinent patents are believed to be U.S. Pat. No. 3,094,058 issued Jun. 18, 1963 to O'Brien, Jr. et al for VENTILATOR and U.S. Pat. No. 4,957,038 issued Sep. 18, 1990 to Hamilton for VENTILATION DEVICE. The O'Brien patent forms an opening intermediate the length of the bottom rail of a sliding door or window frame which is filled by a double wall extrusion having mating and mismating openings therethrough for the passage or air. The Hamilton patent installs an L-shape, in cross section, double wall member between the top rail of a door and the door header. At least one wall of the L-shape member is provided with mating and mismating apertures through which air may flow.

U.S. Pat. No. 1,771,569 issued Jul. 29, 1930 to Benoit for COMBINATION DOOR and U.S. Pat. No. 2,050,362 issued Aug. 11, 1936 to Mims for DOOR VENTILATOR are believed to show the further state-of-the-art. The Benoit patent discloses a storm door having vertical moveable panels which may be screened or provided with louvers which are moved into place for ventilating the upper or lower section of the door. The Mims patent discloses an elongated upright member having louvers or screens closing an elongated frame which is pivoted into position between the door jamb and the edge of the door when the door is ajar to provide ventilation through the door area.

SUMMARY OF THE INVENTION

In a single glass pane type storm door elongated lengths of hollow wall extrusion are interposed between the door stiles and the upper and lower rails and the perimeter of a single glass pane.

The extrusion is cooperatively received by the glass channel groove in the stiles and top and bottom rails of the storm door frame and similarly provides an opposite coextensive opening nesting the perimeter edges of the glass pane.

Opposing walls of the extrusions are provided with transversely aligned apertures and slidably support an elongated channel member having apertures through its channel legs mating and mismating with the extrusion apertures and is manually moved into and out of aperture mating relation by a knob on the outer surface of the extrusion sliding in a slot.

The principal object of this invention is to provide a storm door of the single glass pane type having a substantially continuous series of selectively opened or closed apertures through the storm door inner and outer walls which provide ventilation for an enclosure.

DESCRIPTION OF THE PREFERRED EMBODIMENTS

Like characters of reference designate like parts in those figures of the drawings in which they occur.

Figure 1:
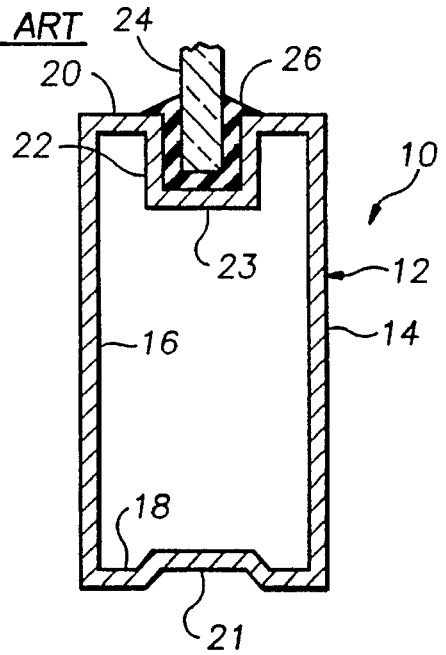
FIG. 1 PRIOR ART
FIG. 1 is a fragmentary vertical cross-sectional view of a prior art storm door frame.
Figure 2:
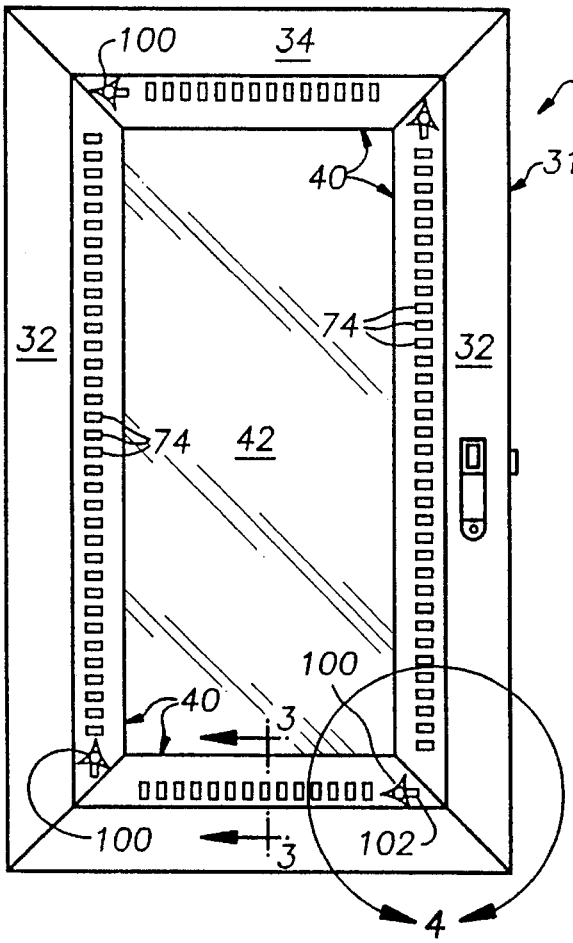
FIG. 2 an elevational view, to a different scale, of the vented storm door.

Referring first to FIG. 1, the reference numeral 10 indicates a typical fragmentary transverse cross section view of a single pane supporting box-like extrusion 12 forming the stiles and end rails of a conventional storm door.

The extruded member 12 is characterized by opposing walls 14 and 16 closed by an outer end wall 18 and closed at its other end by an end wall 20 normal to the extrusion walls 14 and 16. The extruded member 12 forms the stiles and top and bottom end rails of a rigidly connected storm door frame in which the end wall 18 is provided with a recess 21 which receives a sealing member, not shown, for sealing with the door jambs and door header, the bottom rail being provided with a threshold sweep, none of which are shown. The extrusion 12 end wall 20 is provided with a channel recess 22, having a bight portion 23, which receives the marginal edge portion of a single pane glass 24 nested in the channel groove 22 by a seal member 26.

Referring now to the remaining Figures, the reference numeral 30 indicates the storm door of this invention comprising a frame 31 formed by prior art upright stiles 32 connected at their top ends by a rail 34 and at their bottom ends by a threshold rail 36. In the embodiment 30, the conventional single glass pane and its seal have been removed and replaced by a ventilating assembly 40 supporting a single pane of glass 42.

The ventilating assembly 40 comprises an anchor plate 44 and a substantially H-shaped, in cross section, extrusion 46 which supports the glass pane 42.

The anchor plate 44 is substantially T-shaped in transverse section in which the T-bar 45 is elongated strap-like having a coextensive top central groove 48 and lateral coextensive grooves 54 and having flat bottom surfaces 50 on either side of its stem portion comprising laterally spaced channel-like legs 47. Respective side edges of the strap member 45 are provided with outstanding coextensive lugs 52 spaced upwardly from the bottom surfaces 50 in contact with the end wall 20 for a rigid connection with the frame 31. The anchor plate channel legs 47 are snugly received by their outer surfaces contacting the inner wall surfaces of the legs of the channel 22 and terminate adjacent the bight portion 23 of the channel. The anchor plate 44 is secured to the extrusion end by a metallic screw 56 projecting through the plate groove 48 and penetrating the bight portion 23 of the extrusion channel 22.

Figure 3:
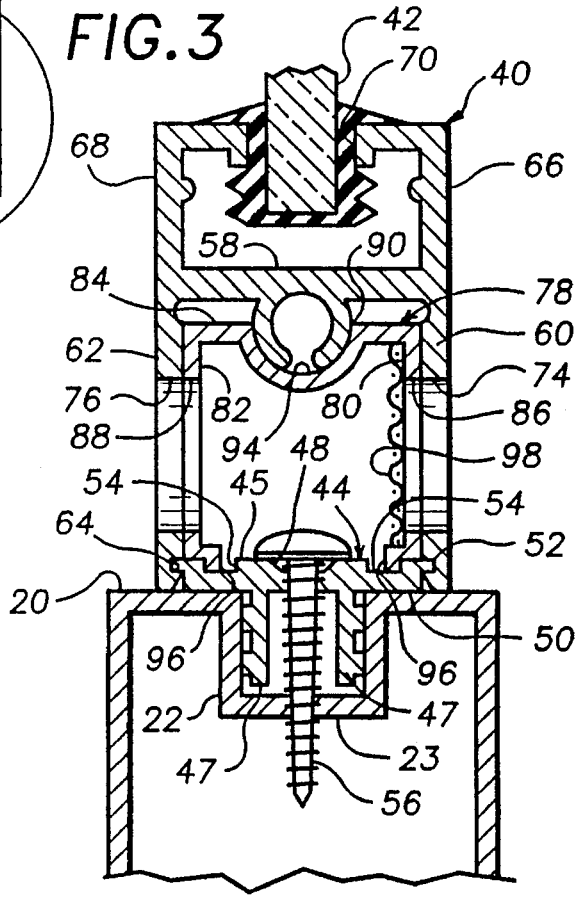
FIG. 3 is a fragmentary vertical cross-sectional view taken substantially along the line 3—3 of FIG. 2; and, FIG. 4 is a fragmentary perspective and cross-sectional view of the area substantially enclosed by the arrow 4 of FIG. 2.
Figure 4:
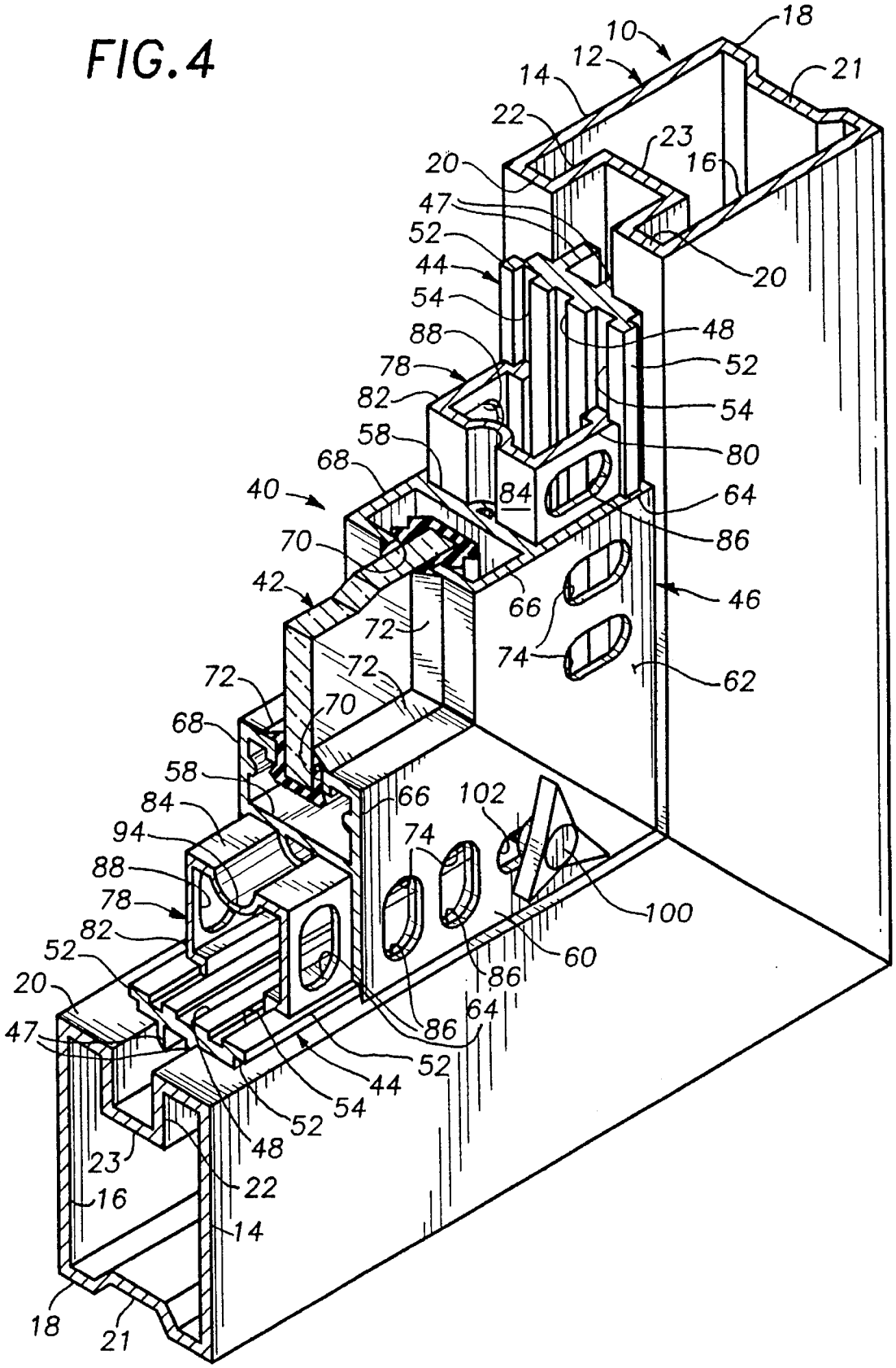

The H-shaped extrusion has a cross bar 58 and a first pair of depending legs 60 and 62, as viewed in FIG. 3, spaced apart a distance substantially equal to the transverse dimension of the anchor plate T-bar 45 and disposed at their ends opposite the cross bar 58 on each side of the anchor plate T-bar adjacent the end wall 20. The inner surface of the end portion of each leg 60 and 62, adjacent the respective side of the anchor plate T-bar, is provided with a coextensive recess 64 nesting the respective lug 52 on the anchor plate side T-bar side edge to secure the H-shaped extrusion 46 to the anchor plate.

A second pair of legs 66 and 68 project coplanar opposite the first pair of legs 60 and 62 and are turned inwardly and downwardly at their end portions opposite the cross bar 58 to form a coextensive opening 70 for receiving a marginal edge portion of the glass pane 42 and a seal 72 securing the glass pane water tight with the walls defining the opening 70.

The H-shaped member first pair of legs 60 and 62 are provided with transversely aligned identical size ovate openings 74 and 76 with the major axis of the respective ovate opening normal to the longitudinal axis of the H-member.

An inverted U-shaped vent opening adjusting channel 78 is disposed between the first pair of legs 60 and 62 with its legs 80 and 82 closely received by the inner surfaces of the legs 60 and 62 and its bight portion 84 disposed adjacent the cross bar 58. The channel legs 80 and 82 are similarly provided with transversely aligned identical size and spaced ovate openings 86 and 88 for mating and mismating with the ovate apertures 74 and 76.

The cross bar 58 is provided with a depending part circular guide 90 which snugly nests, in sliding relation, a semicircular recess 94 formed in the vent adjusting channel bight portion 84 for maintaining the depending edge portions of the channel legs 80 and 82 adjacent the anchor plate 44. The end portions of the channel legs 80 and 82 opposite its bight portion 84 are Z-shaped, as at 96, for cooperative engagement with the anchor plate in the respective anchor plate recess 54.

An elongated section of screen material 98 is secured to the inner surface of the vent adjusting channel leg 80 to preclude insects passing through the air passageway formed by the ovate openings when in aligned relation.

The channel member 78 is manually moved longitudinally to align and mismate the openings 86 and 88 with the apertures 74 and 76 by a control pin 100 secured to the respective channel member 78 and longitudinally slidable in a slot 102 formed in the leg 60.

Operation

Operation seems obvious, but briefly stated, assume the storm door 30 has been provided with the ventilating assembly 40 and supports a single pane of glass 42. In warm weather when ventilation is desired, the pins or knobs 100 are moved in the respective slot 102 in a direction to mate the vent openings in the channel 78 with the respective ovate aperture 74 and 76 of the member 46. In inclement weather, when ventilation is not desired through the doorway closed by the storm door 30, the vent adjusting channels 78 are moved in an opposite direction to mismate the respective ovate openings and apertures.

Obviously the invention is susceptible to changes or alterations without defeating its practicability. Therefore, I do not wish to be confined to the preferred embodiment shown in the drawings and described herein.

I claim:

1. In a storm door frame having an inner perimeter defined by interconnected stiles and rails supporting a single glass pane, the improvement comprising:

ventilating assembly means interposed in substantially planar relationship between the marginal edge of the glass pane and the frame inner perimeter for permitting and interupting air flow through the storm door, said ventilating assembly means comprising:

an elongated anchor plate longitudinally secured to the frame inner periphery;

an H-shaped, in transverse section, member coextensive with said anchor plate, said member having a cross bar and having first and second pairs of parallel legs cooperatively projecting substantially in the plane of the storm door in opposite coplanar relationship from respective ends of the cross bar, said first pair of legs having transversely aligned through apertures, the end portions of said first pair of legs opposite the cross bar gripping opposite sides of said anchor plate, the end portions of said second pair of legs opposite the cross bar being disposed in confronting spaced relation for forming a glass pane marginal edge receiving opening;

a U-shaped channel member between and longitudinally slidable relative to the first pair of legs and having a bight portion adjacent the cross bar and having channel legs having openings for mating and mismating with the first pair of legs apertures; and, means including a knob secured to said channel member and projecting outwardly of said H-shaped member for longitudinally moving the latter.

2. The combination according to claim 1 and further including:

fasteners securing the anchor plate to the frame inner periphery.

3. In a storm door frame having an inner perimeter defined by interconnected stiles and rails supporting a single glass pane, the improvement comprising:

ventilating assembly means interposed in substantially planar relationship between the marginal edge of the glass pane and the frame inner perimeter for permitting and interrupting air flow through the storm door, said ventilating assembly means comprising:

an elongated anchor plate longitudinally secured to the frame inner periphery;

an H-shaped, in transverse section, member coextensive with said anchor plate, said member having a cross bar and having first and second spaced-apart pairs of parallel legs projecting in opposite directions from opposite sides of the cross bar, said first pair of legs having transversely aligned through apertures, the end portions of said first pair of legs opposite the cross bar gripping opposite sides of said anchor plate, said second pair of legs forming a glass pane marginal edge receiving opening;

a U-shaped channel member between and longitudinally slidable relative to the first pair of legs and having a bight portion adjacent the cross bar and having channel legs having openings for mating and mismating with the first pair of legs apertures; and, means including a knob attached to the channel member for longitudinally moving the latter.

4. The combination according to claim 3 and further including:

fasteners securing the anchor plate to the frame inner periphery.

* * * * *